US007866059B2

(12) United States Patent
Yoo et al.

(10) Patent No.: US 7,866,059 B2
(45) Date of Patent: Jan. 11, 2011

(54) METHOD OF CONTROLLING A DRYER

(75) Inventors: Hea Kyung Yoo, Seoul (KR); Seog Ho Go, Gimhae-Si (KR)

(73) Assignee: LG Electronics Inc., Seoul (KR)

( * ) Notice: Subject to any disclaimer, the term of this patent is extended or adjusted under 35 U.S.C. 154(b) by 33 days.

(21) Appl. No.: 11/867,852

(22) Filed: Oct. 5, 2007

(65) Prior Publication Data

US 2008/0184586 A1 Aug. 7, 2008

(30) Foreign Application Priority Data

Oct. 9, 2006 (KR) ..... 10-2006-0098068

(51) Int. Cl.
*F26B 21/06* (2006.01)
*F26B 21/10* (2006.01)

(52) U.S. Cl. ..... 34/427; 34/553; 34/572

(58) Field of Classification Search ..... 34/427, 34/524, 549, 553, 572
See application file for complete search history.

(56) References Cited

U.S. PATENT DOCUMENTS 2,869,247 A * 1/1959 Metzger ..... 34/547
3,417,380 A * 12/1968 Hasbrouck et al. ..... 712/210
3,417,480 A * 12/1968 Thunander ..... 34/528
3,839,951 A * 10/1974 Palmason ..... 99/330
4,327,278 A * 4/1982 Tomaro ..... 392/379
5,044,261 A * 9/1991 Kawazoe ..... 99/280
5,852,881 A * 12/1998 Kuroda et al. ..... 34/572

FOREIGN PATENT DOCUMENTS

JP 63319000 A * 12/1988
JP 07059994 A * 3/1995

* cited by examiner

*Primary Examiner*—Jiping Lu
(74) *Attorney, Agent, or Firm*—Birch, Stewart, Kolasch & Birch, LLP

(57) ABSTRACT

The present disclosure suggests a dryer and method of controlling the same. Disclosed is a dryer, comprising: a heater for heating the air which is to be directed to a dry drum; a motor for rotating the dry drum; a power supply unit for supplying electric current to the heater and the motor; a heater relay for selectively applying electric current to the heater; a motor relay for selectively applying electric current to the motor; a safety relay for selectively applying electric current from the power supply unit to the respective relay; and a control unit for cutting off electric current by turning off the safety relay when an abnormal stop occurs, after the control unit determines whether the abnormal stop occurs during a drying operation.

8 Claims, 4 Drawing Sheets

METHOD OF CONTROLLING A DRYER

CROSS-REFERENCE TO RELATED APPLICATIONS

The present disclosure relates to subject matter contained in priority Korean Application No. 10-2006-0098068, filed on Oct. 9, 2006, which is herein expressly incorporated by reference in its entirety.

BACKGROUND

The present disclosure relates to a dryer and method of controlling the same.

Generally, a drum-type dryer is designed to perform the drying operation while rotating laundry loaded in a dry drum. The laundry rotates and drops by the rotation of the dry drum.

Further, High-temperature dry air inhaled into the dry drum is mixed with the laundry to vaporize the moisture soaked in the laundry. The drum-type dryer may be classified into a condenser-type dryer and an exhaust-type dryer. The former is designed such that the air in the dry drum is directed to a condenser and a heater and is then returned to the dry drum. That is, the air circulates in the dryer without being exhausted out of the dryer. The latter is designed such that the air in the dry drum is directed to the condenser so that the moisture contained in the air can be eliminated and is then exhausted out of the dryer.

Particularly, according to the condenser-type dryer, the air circulating in the dryer absorbs the moisture from the laundry loaded in the drum and then passes through the condenser to be lowered in its temperature by a heat-exchange. As the temperature of the air is lowered, the moisture contained in the air is condensed. The condensed water is pumped out by a condensing pump and is then exhausted to outside. On the other hand, according to the exhaust-type dryer, high-temperature high-moisture air absorbing moisture from the laundry in the drum is exhausted out of the dryer via a lint filter.

Here, both of the exhaust-type and condenser type dryers are the same in that heat-exchange between the high-temperature dry air and the laundry is incurred as the laundry lifts and drops by the rotation of the drum.

In addition, the dryer may be classified into an electric dryer and a gas dryer depending on how to heat up the air which is to be supplied into the dry drum. That is, the dryer is classified into an electric dryer which heats the air by using an electric heater, and a gas dryer which heats the air through gas combustion.

Meanwhile, according to the electric dryer, a plurality of different heaters are installed in a drying duct, wherein a high-temperature heater which generates high calories and a low-temperature heater which generates low calories are installed therein.

Particularly, the high and low temperature heaters repeat on/off simultaneously or individually when the dry operation is performed, thereby controlling an inside of the dry drum to be maintained at a preset temperature.

Further, an electric leakage breaker is provided in the conventional electric dryer. And, the electric leakage breaker detects the leakage current greater than at least 25 mA.

On the contrary, according to the conventional dryer, the leakage current of 5 mA is generated when the dryer is abnormally stopped, and therefore the insulation of the heater is broken due to the moisture inside the dryer, however the electric leakage breaker does not detect the leakage current. In this case, there is a risk of electric shock if a user touches the dryer.

SUMMARY

The present embodiment suggests a dryer and method of controlling the same. In accordance with the embodiments of the invention, there is provided a dryer, including, a heater for heating the air which is to be directed to a dry drum; a motor for rotating the dry drum; a power supply unit for supplying electric current to the heater and the motor; a heater relay for selectively applying electric current to the heater; a motor relay for selectively applying electric current to the motor; a safety relay for selectively applying electric current from the power supply unit to the respective relay; and a control unit for cutting off electric current by turning off the safety relay when an abnormal stop occurs, after the control unit determines whether the abnormal stop occurs during a drying operation.

BRIEF DESCRIPTION OF THE DRAWINGS

The present embodiment will be more fully understood with reference to the accompanying drawings.

DETAILED DESCRIPTION

Hereinafter, the present embodiment will be described by way of illustrative examples with reference to the accompanying drawings.

Figure 1:
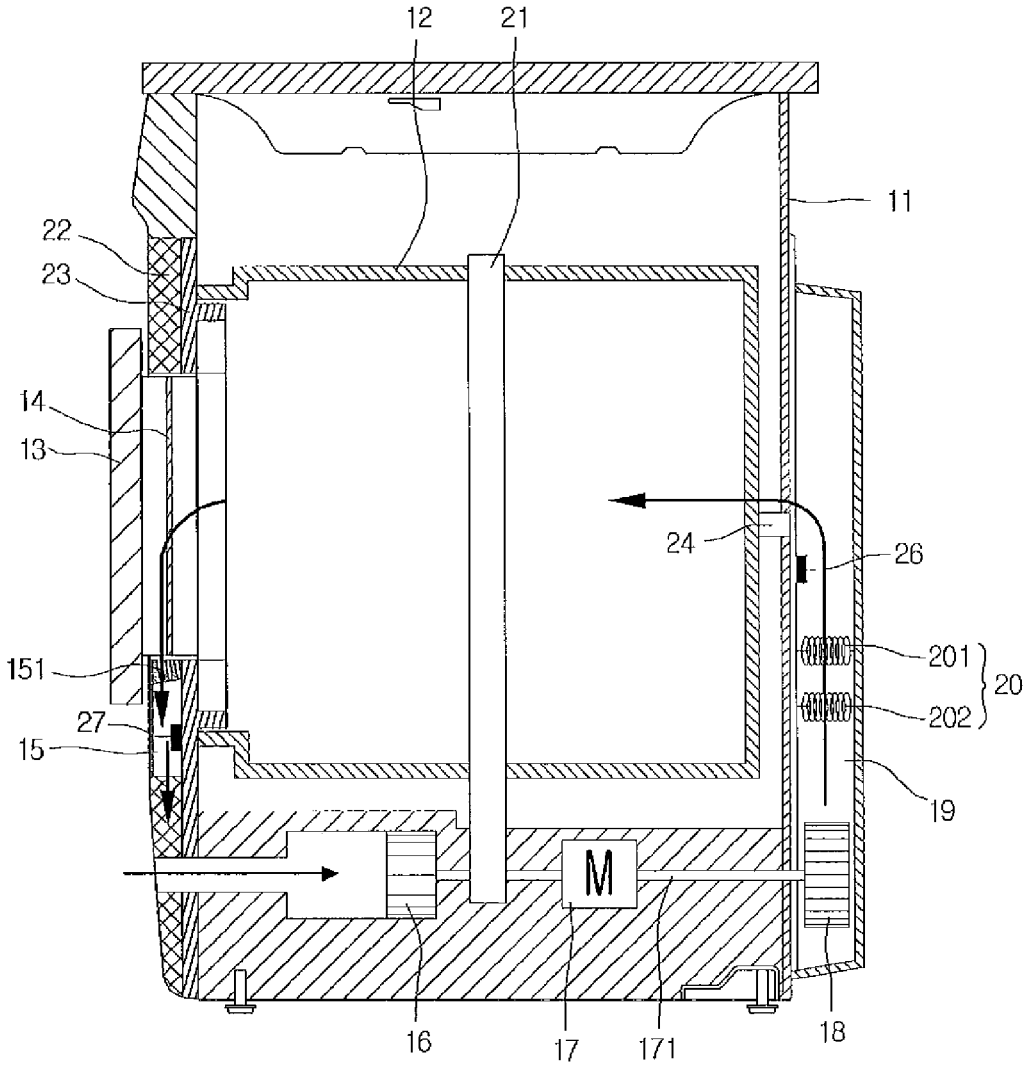
FIG. 1 is a cross-sectional view showing a structure of a dryer according to the present embodiment.

FIG. 1 schematically shows a cross-sectional view of a structure of a dryer according to the present embodiment. Hereinafter, the condenser-type dryer will be explained as a preferred embodiment.

Referring to FIG. 1, the dryer 10 according to the preferred embodiments of the present invention includes a cabinet 11 forming an exterior, a front frame 22 and a front cover 23 which are connected to a front of the cabinet 11, a cylindrical drum 12 formed inside the cabinet 11, a door 13 opening/closing an inlet of the drum 12 as it is mounted on a front portion of the drum 12, a belt 21 rotating the drum 12 as it is surrounded around an outer circumference of the drum 12, and a drum support 24 allowing a rear of the drum 12 to be supported on the cabinet 11. Here, the front portion of the drum 12 is supported by the front cover 23.

In addition, the dryer 10 further includes a motor shaft 171 connected with the belt 21, a motor 17 applying a rotational force to the belt 21 as it is connected with the motor shaft 171, and a cooling fan 16 inhaling indoor air as it is rotated by receiving the rotational force.

In addition, the dryer 10 further includes a drying fan 18 circulating the air inside the drum as it is connected with the motor shaft 171 at an opposite side of the cooling fan 16, and a drying duct 19 transporting the air inhaled by the drying fan 18 to the drum 12, in which a heater 20 is installed.

In addition, the dryer 10 further includes a door lint filter 14 which is formed in a rear of the door 13 to filter fluffs in humid air which is discharged from the drum 12, a body lint filter 151 for filtering the humid air which is passed through the door lint filter 14, and a circulation duct 15 through which the air passed through body lint filter 151 moves to a condenser (not shown).

In addition, the heater 20 includes a high-temperature heater 201 generating heat of approximately 1750 W, and a low-temperature heater 202 generating heat of approximately 750 W. Further, a high-temperature sensor 26 for sensing the temperature of the air which passes through the drying duct 19 is mounted on the surrounding of the heater 20, i.e. the rear of the dry drum 12, and a low-temperature sensor 27 for sensing the temperature of the humid air which passes through the dry drum 12 is mounted on the front of the dry drum 12. Here, various kinds of sensor can be applied as the temperature sensor, for example a thermistor which changes its resistance in accordance with a change in temperature can be used therein.

Hereinafter, the operation of the dryer will be described.

First, if electric power is applied to the dryer, the motor 17 starts to rotate and the heater 20 attached to the inside of the drying duct 19 generates heat. After that, the drum 12 is rotated by the rotation of the belt 21 connected to the motor shaft 171. Particularly, the drum 12 rotates about the drum support 24 as a rotation axis. Further, a dry object in the drum 12 rotates along an inner wall of the drum 12 as the drum 12 rotates, and drops by self-weight at a top of the drum. Here, the dry object is raised by a lifter (not shown) disposed at the inner wall of the drum 12.

Meanwhile, the drying fan 18 connected to the motor shaft 171 is operated at the same time of the rotation of the motor 17, to inhale the circulation air passed through the condenser. The inhaled circulation air rises along the drying duct 19 and becomes a high-temperature and dry air via the heater 20. Further, the high-temperature and dry circulation air passes through the drum 12 while absorbing the moisture from the dry object, and thus, it becomes a high-temperature and humid air.

In addition, the high-temperature and humid air is again filtered by the door lint filter 14 and the body lint filter 151, and then is directed to the condenser along the circulation duct 15.

In addition, when the cooling fan 16 connected to the motor shaft 171 is rotated to inhale the indoor air out of the dryer. And then, the inhaled indoor air is flowed to the condenser through the cooling fan 16.

Here, the high-temperature and humid air flowed along the circulation duct 15 and the indoor air inhaled by the cooling fan 16 are passed through the condenser with being crossed to each other. Also, the high-temperature and humid air and the indoor air just exchange heat, not being mixed due to the configuration of the condenser.

Therefore, the high-temperature and humid air is deprived of heat by the indoor air while passing through the condenser, thereby being changed into a low-temperature and humid air. In addition, as temperature is lowered, moisture contained in the air is condensed and dropped down onto the bottom of the condenser, and then flowed to a sump (not shown) where the condensed water is collected.

Figure 2:
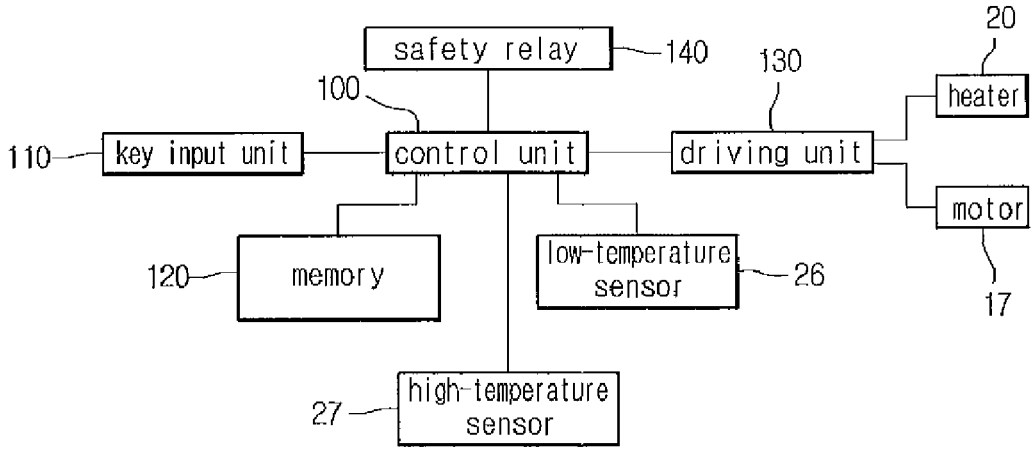
FIG. 2 is a block diagram showing a system of a dryer for embodying the concept of the present embodiment.
Figure 3:
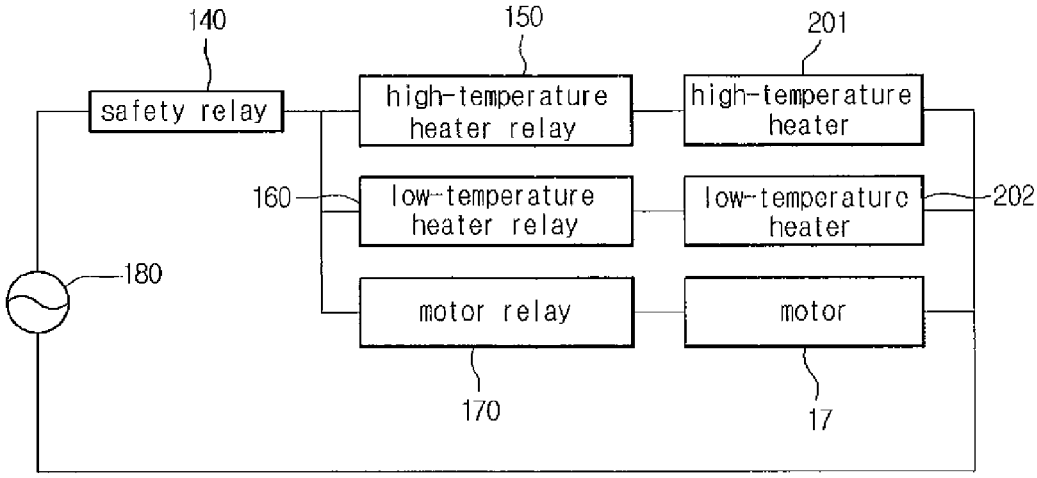
FIG. 3 is a circuit diagram of a dryer according to the present embodiment.

FIG. 2 shows a block diagram of a system of a dryer according to the preferred embodiments of the present invention, and FIG. 3 shows a circuit diagram of a dryer according to the preferred embodiments of the present invention.

Referring to FIG. 2, the system of the dryer according to the preferred embodiments of the present invention includes a control unit 100, a key input unit 110 for inputting dry conditions and operation commands, a driving unit 130 driving the heater 20 or the motor 17 depending on the input dry condition, and a temperature sensor for sensing the temperature of the air which is heated by the heater 20, wherein the temperature sensor includes a high-temperature sensor 26 and a low-temperature sensor 27.

In addition, the system of the dryer includes a safety relay 140 which cut off the electric current due to the malfunction of the dryer, and a memory 120 in which various information such as the command information input by the key input unit 110 and the temperature information transmitted from the temperature sensors 26, 27 are stored.

Referring to FIG. 3, the dryer according to the preferred embodiments of the present invention intermittently transmits the electric current from the power supply unit 180 to the driving unit via the safety relay 140.

Further, the on/off of the high and low temperature heaters 210, 220 are controlled by a high-temperature heater relay 150 and a low-temperature heater relay 160, respectively. The on/off of the motor 17 is controlled by a motor relay 170. And, the high-temperature heater relay 150, the low-temperature heater relay 160 and the motor relay 170 are parallel connected to the safety relay 140.

Therefore, the high and low temperature heaters 210, 220 and the motor 17 are turned on/off by the respective relay 150, 160, 170, independently. And, if the safety relay 140 is turned off, then all of the high and low temperature heaters 210, 220 and the motor 17 are turned off.

Figure 4:
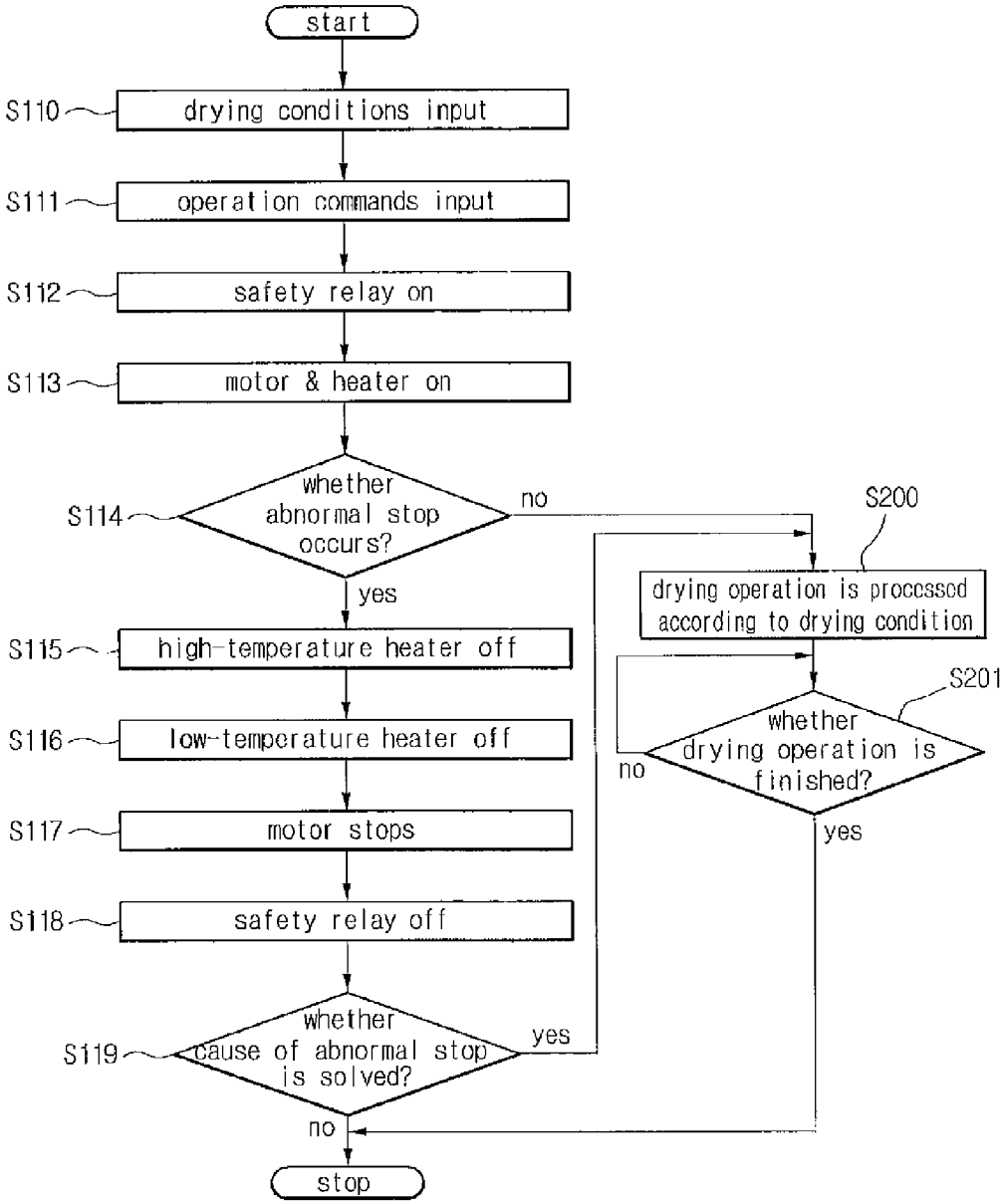
FIG. 4 is a flow chart showing a method of controlling a dryer according to the present embodiment.

FIG. 4 shows a flow chart of a method of controlling a dryer according to the preferred embodiments of the present invention.

Referring to FIG. 4, dry conditions are input by a key input unit (S110), and operation commands are input by a operation button (S111).

Particularly, if the operation commands are input, electric current is applied into the dryer and the safety relay 140 is turned on (S112). And, the motor 17 and the high and low temperature heaters 210, 220 are turned on. And, the motor 17 is rotated at a preset speed according to the input dry conditions, and the high and low temperature heaters 210, 220 are repeatedly turned on/off to maintain the inside of the drum at a preset temperature.

Meanwhile, the control unit 100 determines in real time whether an abnormal stop, such as a stop command is input by the user or an overheating in the dry drum is occurred because the filter is blocked, is occurred or not (S114).

If the abnormal stop does not occur during the whole drying operation, the drying operation is processed according to the input dry condition (S200). And, the operation of the dryer stops or continues after determining whether the drying operation is completed or not (S201).

On the other hand, the abnormal stop is occurred during the drying operation, the high temperature heater is previously turned off (S115), and the low-temperature heater is turned off (S116). And, after the motor is finally stopped (S117), the safety relay 140 is turned off (S118). And, if the cause of the abnormal stop is determined by the control unit 100 to be solved (S119) after determining whether the cause is solved or not, the drying operation is normally carried out (S200 and below steps are carried out) according to the input dry condition.

However, if the cause of the abnormal stop is not solved, the operation of the dryer is terminated. Here, the expression "the cause of the abnormal stop is solved" means that the user re-presses the operation button after pressing the stop button, or that the user cleans the filter after he/she recognizes a filter block signal.

As described in the above description, the electric current, which is to be supplied into the power supply unit 180, is prevented from being leaked out by stopping the heater and the motor as well as by turning off the safety relay 140 when the abnormal stop is occurred. Therefore, it is possible to prevent the user from being struck by the electric current leaked around the surface of the dryer.

What is claimed is:

1. A method of controlling a dryer, comprising the steps of inputting dry conditions and operation commands;

turning a safety relay on;

turning a motor relay and a heater relay on after the safety relay is turned on;

processing a drying operation by turning on the safety relay, the motor relay and the heater relay according to the operation commands, the motor relay and the heater relay being connected in parallel and to the safety relay; and finishing the operation of the dryer as the drying operation is completed, wherein the motor relay is turned off after the heater relay is turned off when an abnormal stop occurs during the drying operation, the safety relay is finally turned off after the motor relay and the heater relay are turned off to cut off the electric current, and wherein the drying operation is normally carried out according to the dry condition and operation commands if the cause of the abnormal stop is solved, and the operation of the dryer is terminated if the cause of the abnormal stop is not solved.

2. The method according to claim 1, wherein the heater relay is composed of a high-temperature heater relay for turning on/off the high-temperature heater and a low-temperature heater relay for turning on/off the low-temperature heater, and wherein the high-temperature heater relay is turned on before the low-temperature heater relay is turned on when the drying operation is started, and the high-temperature heater relay is turned off after the low-temperature heater relay is turned off when the abnormal stop occurs.

3. The method according to claim 1, wherein the abnormal stop includes a case that a stop command is input by the user or a case that an overheating in the dry drum is occurred because the filter is blocked.

4. The method according to claim 3, wherein solving the cause of the abnormal stop comprises re-pressing an operation button after pressing a stop button or cleaning a blocked filter.

5. A method of controlling a dryer, comprising the steps of:

turning a safety relay on;

turning a motor relay and a heater relay on after the safety relay is turned on;

processing a drying operation as the safety relay, the motor relay and the heater relay are turned on, the motor relay and the heater relay being connected in parallel and to the safety relay;

deciding whether an abnormal stop occurs during the drying operation by using a control unit;

turning off the motor relay when the abnormal stop occurs;

turning off the heater relay after turning off the motor relay;

turning off the safety relay finally after turning off the motor relay and the heater relay; and determining whether the cause of the abnormal stop is solved;

wherein the safety relay, the motor relay and the heater relay are normally operated when it is determined that the cause of the abnormal stop is solved; and wherein the operation of the dryer is terminated when the cause of the abnormal stop is not solved.

6. The method according to claim 5, wherein the heater relay is composed of a high-temperature heater relay for turning on/off the high-temperature heater and a low-temperature heater relay for turning on/off the low-temperature heater, and wherein the high-temperature heater relay is turned on before the low-temperature heater relay is turned on when the drying operation is started, and the high-temperature heater relay is turned off after the low-temperature heater relay is turned off when the abnormal stop occurs.

7. The method according to claim 5, wherein the abnormal stop includes a case that a stop command is input by the user or a case that an overheating in the dry drum is occurred because the filter is blocked.

8. The method according to claim 7, wherein solving the cause of the abnormal stop comprises re-pressing an operation button after pressing a stop button or cleaning a blocked filter.

* * * * *